United States Patent [19]

Johnson et al.

[11] Patent Number: 4,768,369

[45] Date of Patent: Sep. 6, 1988

[54] METHOD OF FORMING A PIPE FITTING

[76] Inventors: Russell H. Johnson, 105 Dorsey Way, Louisville, Ky. 40223; Larry L. Bobzien, 4204 Manner Gate Dr., Louisville, Ky. 40220

[21] Appl. No.: 121,331

[22] Filed: Nov. 13, 1987

[51] Int. Cl.[4] ..... B21C 37/29; B21D 7/00

[52] U.S. Cl. ..... 72/368; 72/369; 72/341; 72/256; 72/342; 72/356; 72/377; 29/558

[58] Field of Search ..... 72/368, 352, 369, 354, 72/340, 358, 341, 359, 264, 256, 360, 266, 260, 267, 342, 356, 333, 334, 377; 29/157 A, 157 T, 157 C, 157.1 A, 156.7 B, 156.7 C, 158, 157 B, 558; 10/27 E, 27 PH

[56] References Cited

U.S. PATENT DOCUMENTS

| | | | |
|---|---|---|---|
| 1,100,779 | 6/1914 | Rich | 72/352 |
| 1,124,359 | 1/1915 | Taylor | 72/356 |
| 1,599,931 | 9/1926 | Taylor | 29/157 C |
| 1,854,411 | 4/1932 | Leighton | 72/260 |
| 1,996,838 | 4/1935 | Snell | 29/157 A |
| 2,348,179 | 5/1944 | Moore | 72/343 |
| 3,149,416 | 9/1964 | Moore | 72/334 |
| 3,503,123 | 3/1970 | Law | 72/377 |
| 4,107,972 | 8/1978 | Martin | 72/334 |
| 4,168,619 | 9/1979 | Moore | 72/352 |
| 4,332,156 | 6/1982 | Broodman | 72/264 |

FOREIGN PATENT DOCUMENTS

| | | | |
|---|---|---|---|
| 516653 | 4/1921 | France | 72/267 |

*Primary Examiner*—Lowell A. Larson
*Attorney, Agent, or Firm*—Charles G. Lamb

[57] ABSTRACT

A method of forming a pipe fitting of unitary construction having a tubular section with a radial flange at one end of the tubular construction. The method includes forming a solid cylindrical bar, upsetting one end of the bar to form a head thereon, drawing the remaining cylindrical portion of the bar to increase its length and decrease its circumference, upsetting the head to form the radial flange, and forming a bore through the flange and remaining cylindrical portion of the bar.

7 Claims, 1 Drawing Sheet

METHOD OF FORMING A PIPE FITTING

BACKGROUND OF THE INVENTION

The present invention relates generally to forged pipe joints and couplings, and more particularly relates to a method of forging a unitary pipe fitting.

Pipe fittings are typically fabricated of cast or forged components welded together. However, castings usually require thick wall sections for strength and are, therefore, typically heavy. Casting an item typically results in an item of unknown or questionable structure. Therefore, the cast item must be checked as by a radiographic procedure which is time consuming and expensive. Also, welded constructions create areas of high internal stress which can fracture. In addition, whenever two or more components are assembled, there is a chance of a dimensional tolerance stack-up either to the high side or low side of the tolerance range which results in the assembly being out of dimensional tolerance. Still further, assemblying an item of individual components requires manufacturing time which adds to the cost of manufacture, and each assembly step offers the possibility of introducing an error into the final product being assembled.

The present invention recognizes these drawbacks and provides a solution thereto for making pipe fittings.

SUMMARY OF THE INVENTION

The present invention provides a method for producing a pipe fitting having a tubular section with a radial flange at one end of the tubular section comprising the steps of forming a solid cylindrical bar having a circumference larger than the circumference of the tubular section and smaller than the circumference of the radial flange of the pipe fitting and having a length shorter than the total length of the pipe fitting; upsetting one end of the solid cylindrical bar to form a head having a circumference smaller than the circumference of the finished radial flange and a thickness larger than the thickness of the finished radial flange; concurrently with the forming of the head, lengthening the remaining cylindrical portion of the bar to substantially the finished length of the tubular section of the pipe fitting and reducing the circumference of the remaining cylindrical portion of the bar to substantially the finished circumference of the tubular section of the pipe fitting; upsetting the head to form the radial flange of finished circumference and thickness; and, forming a cylindrical bore through the entire length of and concentric with the cylindrical portion of the bar and through the radial flange concentric with the radial flange.

BRIEF DESCRIPTION OF THE DRAWINGS

A better understanding of the invention will be had upon reference to the following description in conjunction with the accompanying drawings wherein like numerals refer to like parts throughout and in which.

DETAILED DESCRIPTION OF THE PREFERRED EMBODIMENT

Figure 4:
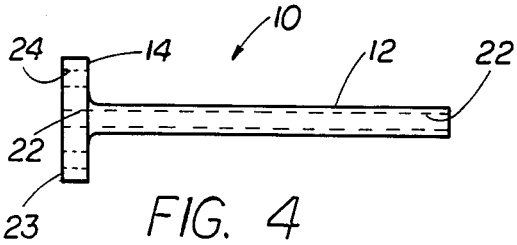

With reference to FIG. 4, there is shown a finished pipe fitting generally denoted as the numeral 10, having a tubular section 12 with a radial flange 14 integrally formed at one end of the tubular section 12.

With reference to FIGS. 1 through 4, there is shown the results of the steps of the method of the present invention. First, a solid cylindrical bar 16 is formed, by, for example, forging, extruding or rolling of the desired material. The desired material is usually an allow high in nickel, chrome or copper, or mixtures thereof. The solid cylindrical bar 16 has a larger circumference than the circumference of the tubular section 12, is smaller in circumference than the circumference of the radial flange 14, and has a length less than the overall length of the pipe fitting including the length of the tubular section 12 and thickness of the radial flange 14.

Figure 1:
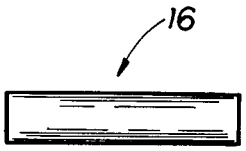
FIGS. 1 through 4 sequentially represent the results of the steps of the present invention for forming a pipe fitting.
Figure 2:
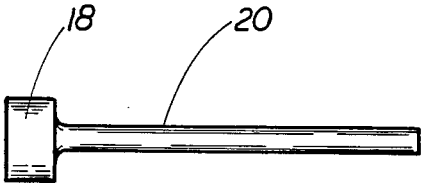

With reference to FIG. 2, one end of the solid cylindrical bar 16 is upset in the longitudinal direction of the solid bar 16 to form a head 18 having a circumference less than the circumference of the finished radial flange 14 and a thickness greater than the thickness of the finished radial flange 14. Concurrently with forming of the head 18, the length of the remaining cylindrical portion 20 of the bar 16 is increased to substantially the finished length of the tubular section 12 and the circumference of the remaining cylindrical portion 20 is reduced to substantially the finished circumference of the tubular section 12 of the pipe fitting 10. This can be accomplished by forging the head 18 while extruding the remaining cylindrical portion 20.

Figure 3:
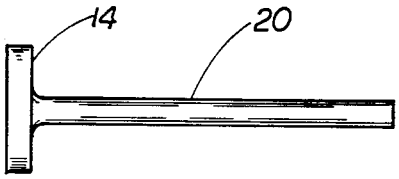

With reference to FIG. 3, after the head 18 is formed and the cylindrical portion 20 is lengthened and reduced in circumference, the head 18 is further upset by forging to form the radial flange 14 of substantially finished circumference and thickness without further affecting the length and circumference of the remaining cylindrical portion 20. This can be accomplished by heating the head 18 and cooling the cylindrical portion 20 to ensure that the dimensions of the cylindrical portion 20 will not be changed by the upsetting of the head 18.

Referring now to FIG. 4, a cylindrical bore 22 is made through the entire length of the cylindrical portion 20 to form the tubular section 12, and through the thickness of the radial flange 14 concentric with the flange 14. The bore 22 has the circumference of the finished bore of the tubular section 12 of the pipe fitting 10. If a pipe fitting 10 is to have a straight tubular section 12, the bore 22 is formed concentrically with the cylindrical portion 20. The face 23, the perimeter of the flange 14, and the perimeter of the tubular section 13 can be machined to a final dimension and surface finish if necessary to meet particularly critical dimensional and surface finish requirements.

Figure 5:
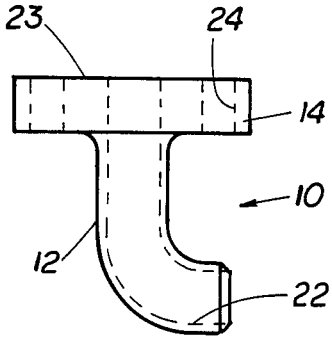
FIG. 5 represents the result of a further step of the present invention for forming a pipe fitting.

With reference now to FIG. 5, if it is desired that the pipe fitting 10 be formed as an elbow, after the bore 22 is made in the cylindrical portion 20 forming the tubular section 12, the tubular section 12 is bent through an arc corresponding to the angle of the elbow desired. As shown, the tubular section 12 is bent through an arc of 90 to form a right angle elbow. It is also realized that, the bore 22 can be formed asymetrically to the longitudinal centerline of the cylindrical portion 20 in an offset direction to compensate for the subsequent wall thickening at the inside arc of the elbow and wall thinning at the outside arc of the elbow which will take place during the bending of the tubular section 12 so that the wall thickness of the arcuate tubular section 12 will be substantially uniform about the bore 22.

With continued reference to FIGS. 4 and 5, after the pipe fitting 10 is formed, fastener receiving poles 24 are formed through the thickness of the flange 14. As shown, the fastener receiving holes 24 can be located at spaced apart intervals circumferentially of the flange 14. The holes 24 can be sized to receive, for example, bolts to fasten the radial flange 14 to a mating flange on the pipe to which the pipe fitting 10 is to be connected when installed in a pipe system.

Figure 6:
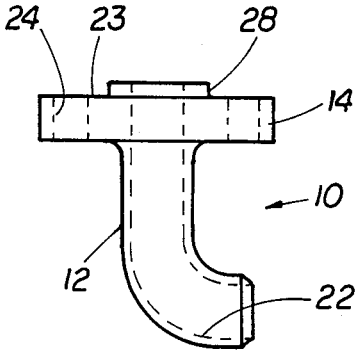
FIG. 6 represents the result of yet another step of the present invention for forming a pipe fitting.

Now with reference to FIG. 6, the exposed or mounting surface 23 of the radial flange 14 can be further formed with circular collar 28 concentrically with the bore 22, integral with the radial flange, and extending outwardly from the mounting surface 23 of the radial flange 14. The collar 28 can advantageously be formed in the flange 14 prior to bending of the cylindrical portion 20.

The foregoing detailed description is given primarily for clearness of understanding and no unnecessary limitations are to be understood therefrom for modifications will become obvious to those skilled in the art upon reading the disclosure and may be made without department from the spirit of the invention and scope of the appended claims.

What is claimed:

1. A process for producing a pipe fitting having a tubular section with a radial flange at one end of the tubular section comprising the steps of:

forming a solid cylindrical bar having a circumference larger than the circumference of the tubular section and smaller than the circumference of the radial flange of the pipe fitting and having a length shorter than the total length of the pipe fitting;

upsetting one end of the solid cylindrical bar to form a head having a circumference less than the circumference of the finished radial flange and a thickness larger than the thickness of the finished radial flange;

concurrently with the forming of the head, increasing the length of the remaining cylindrical portion of the bar to substantially the finished length of the tubular section of the pipe fitting and reducing the circumference of the remaining cylindrical portion of the bar to substantially the finished circumference of the tubular section of the pipe fitting;

upsetting the head to form the radial flange of substantially finished circumference and thickness; and, making a cylindrical bore through the entire length of and concentric with the cylindrical portion of the bar to form the tubular section, and through the radial flange concentric with the radial flange circumference.

2. The process of claim 1, wherein the step of making the bore comprises making the cylindrical bore symetrical of the longitudinal centerline of the cylindrical portion to form the tubular section.

3. The process of claim 2, further comprising the step of bending the tubular section into an arc along the longitudinal axes of the bore therethrough.

4. The process of claim 1, further comprising the step of:

making the bore asymetrical of the longitudinal centerline of the cylindrical portion to form the tubular section; and bending the tubular section into an arc along the longitudinal axes of the bore therethrough..

5. The process of claim 1, further comprising the step of forming fastener receiving holes through the circumferential flange at spaced apart intervals circumferentially of the flange.

6. The process of claim 1, further comprising the step of forming a circular collar concentric with the bore, integral with the flange, and extending outwardly from the flange, the collar having a smaller circumference than the flange.

7. The process of claim 1, wherein the step of upsetting the head comprises heating the head and cooling the cylindrical portion prior to upsetting the head to form the flange so that the dimensions of the cylindrical portion will not be changed by the upsetting of the head.

* * * * *